United States Patent [19]

Johnston

[11] Patent Number: 5,076,576

[45] Date of Patent: Dec. 31, 1991

[54] THERAPEUTIC LEVERAGING DEVICE

[76] Inventor: Thomas L. Johnston, 43 Benedict Rd., Pittsford, N.Y. 14534

[21] Appl. No.: 638,074

[22] Filed: Jan. 7, 1991

[51] Int. Cl.[5] ..... A63B 21/00

[52] U.S. Cl. ..... 272/121; 272/126; 128/25 R

[58] Field of Search ..... 272/126, 900, 902, 903, 272/93, 116, 117-119, 143, 121; 128/25 R, 25 B, 26

[56] References Cited

U.S. PATENT DOCUMENTS

| | | | |
|---|---|---|---|
| 195,116 | 9/1877 | Foster | 272/121 |
| 1,612,496 | 12/1926 | Dobbins | 272/126 |
| 1,701,747 | 2/1929 | Dobbins | 272/126 |
| 3,834,694 | 9/1974 | Pridgen | 272/903 X |
| 4,205,839 | 6/1980 | Best | 272/126 |
| 4,574,789 | 3/1986 | Forster | 272/900 X |
| 4,619,453 | 10/1986 | Plumridge | 272/900 X |
| 4,634,118 | 1/1987 | Jensen | 272/902 X |

*Primary Examiner*—Richard J. Apley
*Assistant Examiner*—Linda C. M. Dvorak
*Attorney, Agent, or Firm*—Howard J. Greenwald

[57] ABSTRACT

An apparatus for stretching a joint of the human body (such as a knee joint) is disclosed. This apparatus contains an extension harness, a line cord, a first guide for the line cord which preferably is attached to the harness (such as grommets in the harness or pulley blocks attached to the harness), a second guide for the line cord (such as a pulley system, or an eye hook), and an anchor. When the harness secured around a patient's knee and attached to an anchoring surface, movement of the line cord causes movement of the harness.

12 Claims, 8 Drawing Sheets

THERAPEUTIC LEVERAGING DEVICE

FIELD OF THE INVENTION

A stretching device which may be used to flex and extend scar tissues that form after reconstructive knee surgery is disclosed.

BACKGROUND OF THE INVENTION

Exercise devices which may be used to stretch scarred joints are well known to those skilled in the art.

By way of illustration, in 1961 Anthony Fuchs disclosed an exercising device which could be used for stretching a knee joint. In his U.S. Pat. No. 3,000,632, Fuchs disclosed a device comprised of a chair with a seat, a horizontally disposed transverse rod mounted adjacent to the seat, and a laterally extending rigid arm. The device of Fuchs appears to be relatively bulky, heavy, complicated, and expensive.

In 1978 Guido Koch disclosed a knee bending device in his U.S. Pat. No. 4,114,610. The device of this patent also is relatively bulky heavy, complicated, and expensive; it is comprised of a chair including a back support and arm rests, a hand-actuated, U-shaped, pivotally mounted stirrup with two substantially parallel limbs, and a connecting central bar.

In 1984, in his U.S. Pat. No. 4,463,947, Arthur Kloenne disclosed a knee and leg orthopedic exercising device The device of the Kloenne patent allegedly is ". . . capable of different degrees of participation or activity, depending upon the condition of the user (see column 1)." However, like the prior art devices discussed above, Kloenne's device is also rather complicated, bulky, and heavy. It is comprised of a chair, a wide leg rest with a vertical shank portion that is supported from a generally perpendicular crown portion, and a base portion comprised of roller means.

In 1985, in his U.S. Pat. No. 4,509,509, a reciprocating apparatus for treating human joints was disclosed by Jean Bouvet et al. This apparatus included an electrical stimulator, an electrically-actuated switch device, a control circuit, a pair of limit switches, a hydraulic cylinder, a base, roller means, and means for supporting one leg. In the operation of the rather complex device of this patent, once current flows to the device, a solenoid is activated, and a piston is caused to move within an air cylinder, thereby causing movement of the support means on which the patient's leg is mounted.

In 1986, in their U.S. Pat. No. 4,599,996, Nancy Seith and Robert C. Johnson disclosed an adjustable limb manipulating device. The device of this patent is comprised of a base adapted to be supported on the thigh of a patient's limb, an elongated extensible and retractable lever pivoted to the base, and a extensible and retractable lifter member having a stirrup portion. The device of this patent allows only a limited range of motion, does not provide any mechanical advantage to the user, and is not suitable for use by invalids who often do not possess a great deal of strength.

In 1987, in his U.S. Pat. No. 4,637,379, John H. Saringer disclosed a device for imparting continuous passive motion to a leg joint. The device of this patent contained an elongated base, a foot rest, a first member with a lower pivotal connection to traveling means, a second member, means for latching the first member to the second member, a spacing member, motor means, and control means. The device of this patent is complicated, cumbersome, and costly.

In 1988, in his U.S. Pat. No. 4,784,121, Lester N. Brooks discussed prior art devices which were adapted to articulate, or flex, a knee joint. At column 1 of his patent, Brooks noted that "A further class of exercisers provides upper body assistance, primarily through the user's arms in articulating the knee . . . U.S. Pat. Nos. 2,772,881—Fundom, 3,000,632—Fuchs and 4,114,610—Koch exemplify this class. The Fundom exerciser is relatively complicated. It has a further shortcoming in that flexion of the knee joint is not as fully controlled as would normally be desired. The Fuchs and Koch exercisers are incorporated into the structure of a chair . . . Although these devices provided the desired end of flexing a knee . . . , shortcomings still exist . . . The prior devices fail to provide a degree of control over leg movement which allows the user to determine the rate and extent of movement consistent with his tolerance to the pain involved, or with his desire to stress the leg muscles (see column 1 of the patent)"

Despite his recognition of the shortcomings of the prior art devices, the device disclosed in Brooks' U.S. patent also has substantial disadvantages. In the first place, it does not allow for full extension of the user's knee joint. In the second place, it has to be used in conjunction with a chair, thereby preventing the user from fully flexing the knee joint. In the third place, it does not provide mechanical advantage to the user, and thus cannot advantageously be used by invalids who might not possess a substantial amount of strength and endurance.

Another discussion of knee extending devices was presented in Stephen A. Rogers' U.S. Pat. No. 4,884,454 devices . . . have been proposed for use in facilitating knee and leg rehabilitation, some of such devices being disclosed in U.S. Pat. Nos. 4,114,610, 3,000,632, 4,463,947, 4,637,379, 4,509,509, and 4,599,996. Although some of the apparatus disclosed in these patents and elsewhere would apparently accomplish the desired knee and leg therapy and rehabilitation, such apparatus typically is also complicated in structure, cumbersome, and costly."

The device of the Rogers patent, notwithstanding Rogers' appreciation of the shortcomings of the prior art, is relatively expensive, fails to provide substantial mechanical advantage to the user, and is relatively cumbersome.

Thus, as least as late as 1989, the prior art did not provide a knee stretching device which (1) allowed for full knee joint flexion, (2) allowed for full knee joint extension, (3) provides a substantial mechanical advantage to the user which may be maintained by him for relatively long periods of time (4) was relatively lightweight, (5) was simple in structure, (6) was easy to use, (7) was relatively inexpensive.

It is an object of this invention to provide a device for stretching a knee joint which may be used in an environment containing a substantial amount of water (such as a whirlpool bath or a sauna) without substantial risk of deterioration of the device.

It is another object of this invention to provide a device for stretching a knee joint which is relatively inexpensive.

It is another object of this invention to provide a device for stretching a knee joint which is relatively lightweight, portable, and easy to use.

It is another object of this invention to provide a device for stretching a knee joint which allows the user to fully extend the knee joint.

It is another object of this invention to provide a device for stretching a knee joint which allows the user to fully flex his knee joint.

It is another object of this invention to provide a device for stretching a knee joint which provides a substantial amount of mechanical advantage to the user so that one may stretch his knee joint to the desired extent for a relatively long period of time.

It is another object of this invention to provide a device for stretching a knee joint which allows the user of the device to control the amount of stretch and, thereby, to minimize the amount of protective muscle guarding of the knee joint which will exist.

SUMMARY OF THE INVENTION

In accordance with this invention, there is provided self-actuated apparatus for the controlled stretching of a knee joint. This apparatus is comprised of an extension harness, line cord, at least four pulley wheels, and at least two pulley hooks.

BRIEF DESCRIPTION OF THE DRAWINGS

The present invention will be more fully described by reference to the following detailed description thereof, when read in connection with the attached drawings, wherein like reference numerals refer to like elements, and wherein.

DESCRIPTION OF THE PREFERRED EMBODIMENTS

Figure 1:
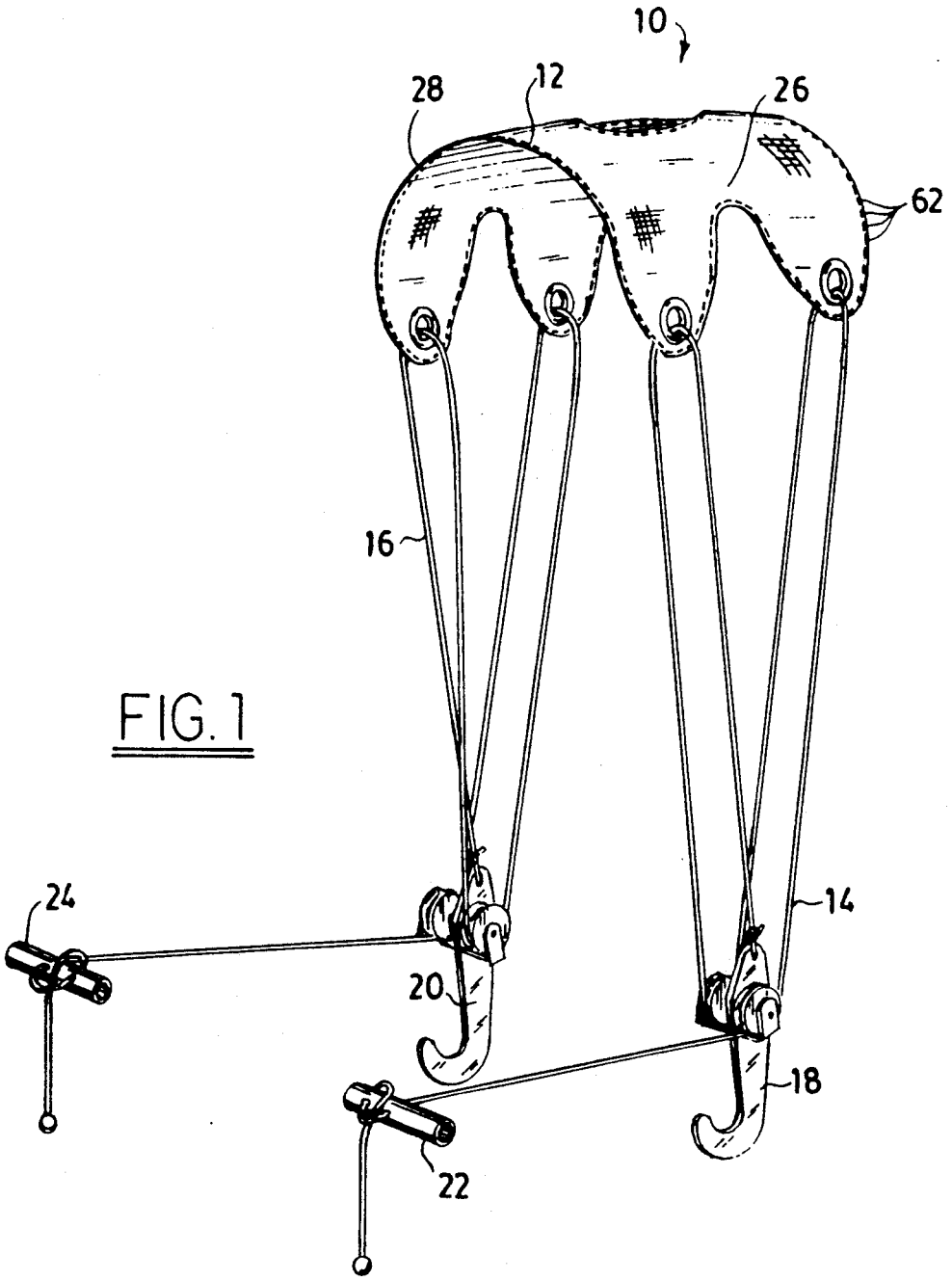
FIG. 1 is a perpsective view of the apparatus of this invention.

One of the preferred embodiments of applicant's invention is illustrated in FIG. 1. Referring to FIG. 1, leveraging device 10 is comprised of harness 12, line 14, line 16, pulley system 18, pulley system 20, handle 22, and handle 24. As will be apparent to those skilled in the art, as handle 22 is moved, it causes line 14 to move the right half 26 of harness 12. By the same token, as handle 24 is moved, it causes line 16 to move the left half 28 of harness 12.

Figure 2A:
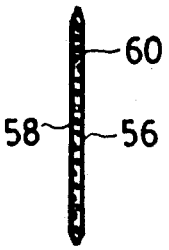
FIG. 2A is a side view of the harness of said apparatus.
Figure 2:
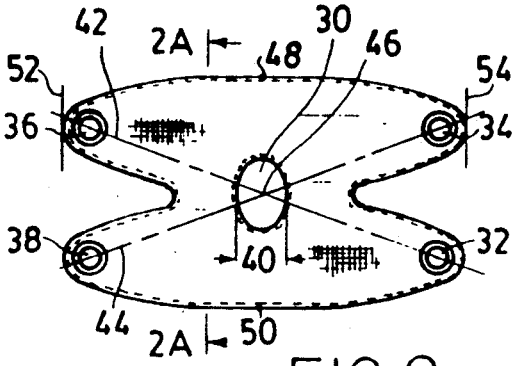
FIG. 2 is a top view of the harness of said apparatus.

FIG. 2 is a top view of the harness 12 shown in FIG. 1. Referring to FIG. 2, it will be seen that preferred harness 12 is an integral, flexible member comprised of at least one orifice and, preferably, at least five orifices such as orifices 30, 32, 34, 36, and 38.

Figure 5:
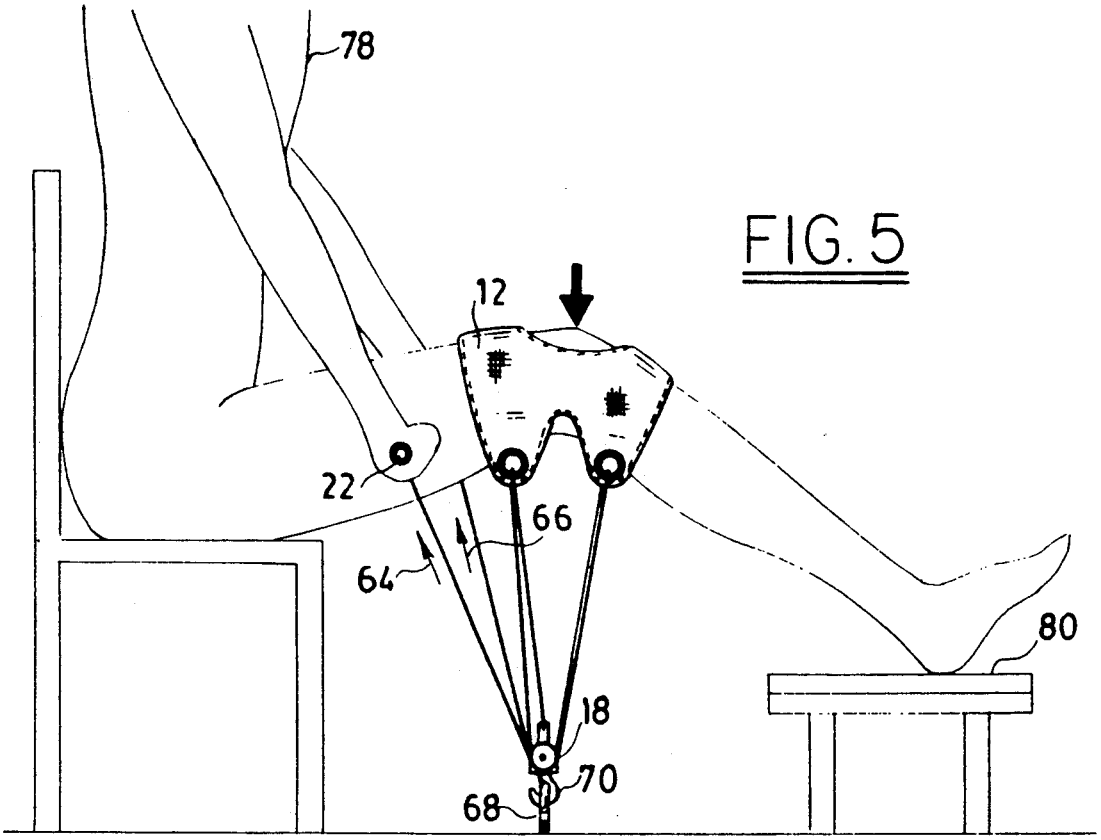
FIGS. 5 and 6 are operational views of the apparatus of FIG. 1.

Orifice 30 is the opening through which the patient's knee cap will extend (see FIG. 5). Orifice 30 may be of any shape such as, e.g., a circular shape, an oval shape, a rectangular shape, an irregular shape, etc. It is essential that the maximum dimension of orifice 30 be at least about 4 inches and, preferably, be from about 4 to about 7 inches. Furthermore, the width 40 of orifice 30 must be at least about 3 inches.

It is preferred that orifice 30 be substantially centered within harness 12. Thus, if a line 42 is drawn from the midpoint of orifice 34 to the midpoint of orifice 36, and another line 44 is drawn from the midpoint of orifice 32 to the midpoint of orifice 38, these lines 42 and 44 will intersect at a point 46 which is at the centerpoint of harness 12. The center of orifice 30 should substantially coincide with centerpoint 46.

The maximum width of harness 12 (i.e., the maximum dimension measured across the harness) may be measured from about point 48 to about point 50; and it must be at least about 10 inches and, preferably, must be from about 11 to about 16 inches.

The maximum length of harness 12 (i.e., the maximum dimension measured from the left side of the harness to the right side of the harness) may be measured from about point 52 to about point 54. The maximum length of harness 12 should be at least about 15 inches and, preferably, should be from about 19 to about 24 inches.

In addition to orifice 30, harness 12 also may comprise at least four additional orifices such as orifices 32, 34, 36, and 38.

At least two of the additional orifices should be located within the top 40 percent of the maximum width of harness 12. Thus, for example, if the maximum width of harness 12 is 10 inches (as measured from point 48 to point 50), then orifices 32 and 36 should appear within the top 4 inches of the maximum width. By the same token, At least two of the additional orifices should be located within the bottom 40 percent of the maximum width of harness 12 (such as, e.g., orifices 34 and 38).

At least two of the additional orifices (such as, e.g., orifices 36 and 38) should be located within the first 30 percent of the maximum length of harness 12, as measured from left to right (from point 52 to point 54). Thus, by way of illustration, if the maximum length (as measured from point 52 to point 54) is 20 inches, then orifices 36 and 38 should be located within an area no greater than about 6 inches from point 52 (as measured towards point 54). In one preferred embodiment, illustrated in FIG. 2, at least two of the additional orifices are located within the first 15 percent of the maximum length of harness 12, as measured from point 52 to point 54.

At least two of the additional orifices (such as, e.g., orifices 32 and 34) should be located within the last 30 percent of the maximum length of harness 12, as measured from right to left (from point 54 to point 52). Thus, by way of illustration, if the maximum length (as measured from point 54 to point 52) is 20 inches, then orifices 32 and 34 should be located within an area no greater than about 6 inches from point 54 (as measured towards point 52). In one preferred embodiment, illustrated in FIG. 2, at least two of the additional orifices are located within the first 15 percent of the maximum length of harness 12, as measured from point 54 to point 52.

In the preferred embodiment illustrated in FIGS. 1 and 2, each of additional orifices 32, 34, 36, and 38 is a grommet. As is known to those skilled in the art, a grommet is a reinforced orifice through which some material, like line 14, may be passed. The reinforcement may be a metal ring, e.g.

In one preferred embodiment, the reinforcement which is used to form grommets 32, 34, 36, and 38 is a two-piece ring comprised of interior plastic material and exterior metal alloy. These reinforcing rings are sold under the name of a "AB 20 stainless steel press ring" by the Bainbridge Aqua Battan Company of 252 Revere Street, Canton, Mass.

The reinforcing ring may be inserted into harness 12 by means well known to those skilled in the art. Thus, by way of illustration and not limitation, one may punch a hole in harness 12 with a die, position both halves of the reinforcing ring within a hydraulic ring press with the hole of the harness in the middle, and compress the reinforcing ring by the press to form the grommet.

It is preferred that the reinforcing ring(s) used in harness 12 to form grommets 32, 34, 36, and 38 be suited to impart a minimum amount of friction to line 24 and/or line 16. Those skilled in the sailboat rigging art are well aware of the existence of reinforcing rings which are specially designed to minimize friction between the surfaces of such rings and the lines which pass through them.

Referring to FIG. 2A, which is a cross-sectional view of harness 12, taken across lines 2A—2A of FIG. 2, it will be seen that integral harness 12 has a sandwich structure and is comprised of at least three layers of material.

Referring again to FIG. 2A, it will be seen that harness 12 is comprised of at least two outer layers (such as outer layers 56 and 58) and at least one inner layer (such as, e.g., inner layer 60).

It is preferred to form harness 12 by positioning layers 56, 60 and 58 together and then joining them by suitable means known to those skilled in the art. Thus, e.g., such layers may be adhesively joined. Thus, for example, such layers may be sewn together. Thus, referring to FIGS. 1 and 2, it will be seen that layers 56, 60 and 58 are preferably held together by stitches of thread. As is known to those skilled in the art, the term thread refers to a fine cord of fibrous material which preferably is made of two or more filaments twisted together.

When layers 56, 60, and 58 are joined by sewing, it is preferred to use thread which is substantially waterproof. Thus, e.g., one may use a thread which consists essentially of a synthetic polymeric material.

One preferred thread which may be used to join together layers 56, 60, and 58 consists essentially of "DACRON." As is known to those skilled in the art, "DACRON" is a trademark owned by the E.I. duPont de Nemours and Company of Wilmington, Del. which describes a polyester fiber made from polyethylene terephthalate.

It is preferred that each of layers 56 and 58 be comprised of at least about 75 weight percent of a synthetic polymeric material such as, for example, nylon, polyester, polypropylene, and the like. A different synthetic polymeric material may be used in each of layers 56 and 58. In one embodiment, the same synthetic polymeric material is used in 56 and 58.

In one preferred embodiment, at least one of layers 56 and 58 is a coated fabric. As is well known to those skilled in the art, the desirable properties of a fabric can be supplemented by coating it with a polymer; see, e.g., pages 205–218 of J. L. Kroschwitz's "Polymers: fibers and Textiles, A Compendium" (John Wiley and Sons, New York, 1990), the disclosure of which is hereby incorporated by reference into this specification. In one preferred embodiment, at least one side of each of layer 56 and of layer 58 is coated with a polyurethane material.

In one preferred embodiment, at least about 75 weight percent of each of layers 56 and 58 is comprised of nylon. As is well known to those skilled in the art, nylon is a long chain polymeric amide. See, e.g., pages 552–554 of Henry R. Clauser's "Materials Handbook," Twelfth Edition (McGraw-Hill Book Company, New York, 1986), the disclosure of which is hereby incorporated by reference into this specification.

In one embodiment, each of layers 56 and 58 is made from a nylon fabric coated with a polyurethane material. In this embodiment, the nylon fabric preferably is "PARAPAC nylon pack cloth" obtainable from Astrup Distributors of 2937 West 25th Street, Cleveland, Ohio.

Referring again to FIG. 2A, in harness 12 layers 56 and 58 are preferably sewn together so that they form an interior cavity. It is preferred that substantially all of the space of such interior cavity be filled with foam material and that, thus, layer 60 consist essentially of foam.

As is known to those skilled in the art, foam materials are materials with a spongelike, cellular structure and include, e.g., polyurethane foams, sponge rubber, plastic foams, glass foams, refractory foams, metal foams, and the like. These foams, and other foam materials, are described on pages 329–331 of Henry R. Clauser's "Materials Handbook," supra.

In one preferred embodiment, the foam material used does not absorb water. Thus, by way of illustration, one may use celltight and gastight cellular rubber with a density of from about 3.5 to about 12 pounds per foot. Thus, e.g., one may use a foamed vinyl plastisol such as "ENSOLITE" (sold by Uniroyal, Inc. of Naugatuck, Conn.), "VINYLAIRE" (sold by Dura Flex Company), and the like.

In one preferred embodiment, the foam used in layer 60 is 0.25 inch thick, high-density "ENSOLITE" foam.

It is preferred that the total thickness of layers 56, 60, and 58 be from 0.125 to about 0.50 inches thick. It is even more preferred that the combined thickness of layers 56, 60, and 58 be from about 0.2 to about 0.4 inches.

In one preferred embodiment, the interior layer 60 consists essentially of fiberfill. As is known to those skilled in the art, fiberifll is a fiber designed specifically for use as a filling material in such products as pillows, comforters, quilted linings, and the like.

In one preferred embodiment, the interior layer 60 is comprised of cloth.

Referring again to FIG. 1, the leveraging device 10 of this invention is comprised of at least one line cord such as, e g., line cord 14. The line cord used in the process of this invention is similar to the line cord used in sailboat rigging and is well known to those skilled in the art. Thus, by way of illustration and not limitation, one may use any of the line cords described in the Summer, 1989 catalog of West Marine Products, P.0. Box 1020, Watsonville, Calif., the disclosure of which is hereby incorporated by reference into this specification.

It is preferred that the line cord used in the device of this invention have a diameter of from about 0.1 to about 0.5 inches and, preferably, from about 0.2 to about 0.4 inches. The line cord may consist essentially of a synthetic polymeric material such as "DACRON," and/or nylon, and/or "KEVLAR" (an aromatic polyamide fiber sold by the E.I. du Pont de Nemours and Company of Wilimington, Del.).

In one preferred embodiment, the line cord used is a woven polyester line with a diameter of about 0.16 inches which is sold by The Lehigh Group of Allentown, Pa.

In the preferred embodiment illustrated in FIG. 1, at least two line cords (cords 14 and 16) are used in applicant's leveraging device. Cord 14 passes through grommets 32 and 34 and through pulley system 18. Cord 16 passes through grommets 36 and 38 and through pulley system 20.

Figure 3:
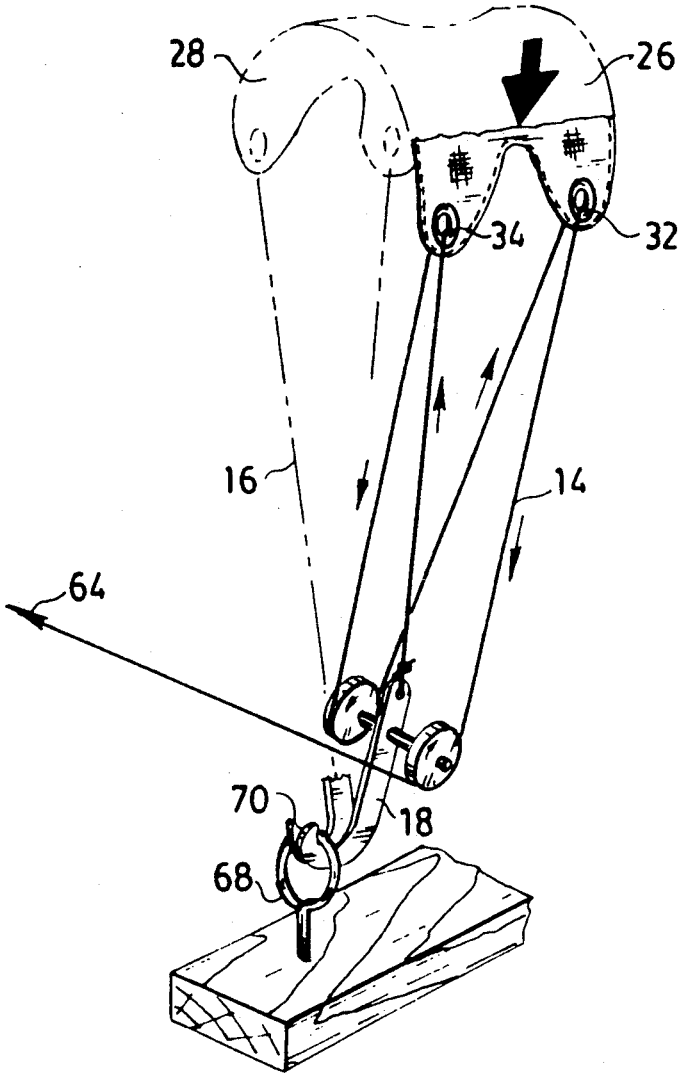
FIG. 3 is another perspective view of the embodiment of FIG. 1, illustrating how it works when it is secured to surface.

FIG. 3 illustrates the direction of travel of line 14 when force is applied in the direction of arrow 64 by pulling on handle 22 (not shown). As line 14 is pulled in the direction of arrow 64, the system line 14 shortens, thereby pulling down the right half 26 of harness 12. By the same token, when line 16 (not shown in FIG. 3) is pulled in away from pulley assembly 20 (not shown), the left half 28 of harness 12 is pulled down. Thus, as handles 22 and 24 are pulled, both halves 26 and 28 of harness 12 are pulled down simultaneously.

Any suitable pulley assembly may be used in applicant's leveraging device 10. As used in this specification, the term pulley assembly refers to device comprised of securing means (such as hook 70) and, at least two pulley wheels operatively connected to hook 70). This assembly is often referred to as a "pulley hook" and may be purchased, e.g., from Windsurfing Hawaii, Inc. of Post Office Box 765, Stevenson, Wash. 98648 as part number 01405.

Figure 4A:
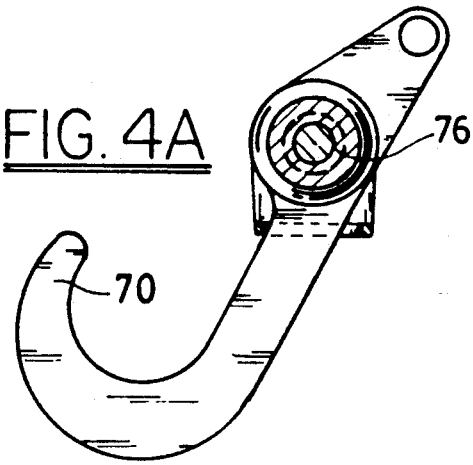
FIG. 4A is a side view of a pulley hook used in the apparatus of FIG. 1.
Figure 4:
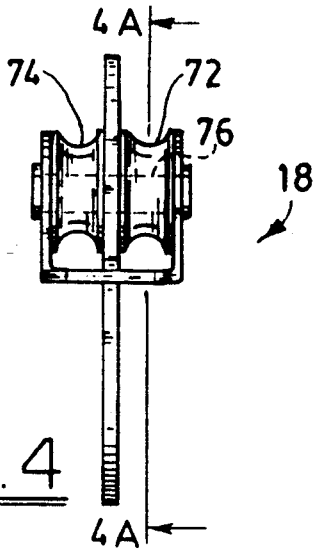
FIG. 4 is a front view of a preferred pulley used in the apparatus of FIG. 1.

FIG. 4 is a partial front view of pulley system 18. In the preferred embodiment shown in FIG. 4, it will be seen that pulley system 18 is comprised of pulley wheels 72 and 74 mounted on shaft 76. In another embodiment, not shown, pulley assembly 18 contains six pulleys.

It will be appreciated that the leveraging apparatus 10 of this invention preferably contains from about 1 to about 2 pulley hooks 70 and from about 2 to about 6 pulley wheels.

FIG. 4A is a side view of pulley assembly 18.

It is preferred that pulley assembly 18 and/or pulley assembly 20 be constructed of materials such that they will not be corroded by water. Thus, by way of illustration, each of said pulley assemblies is comprised of stainless steel.

Figure 6:
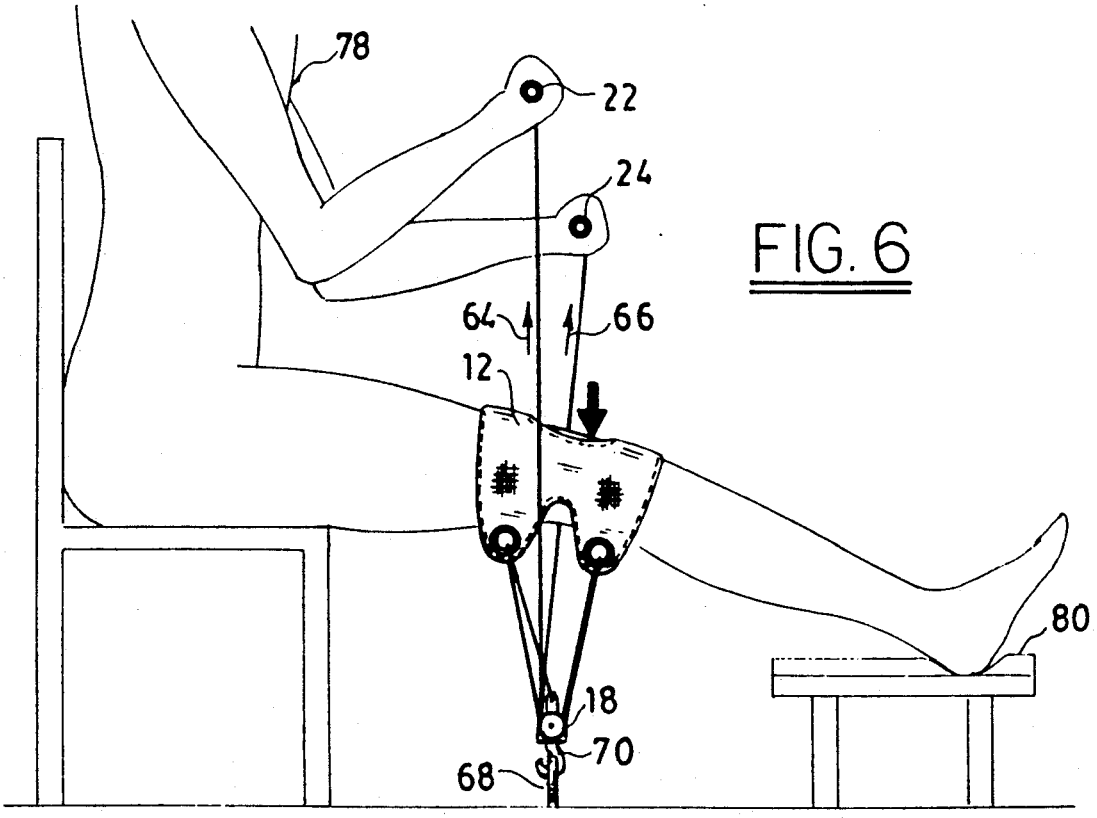

FIGS. 5 and 6 illustrate the leveraging device of this invention in use by a patient 78. Referring to these Figures, it will be seen that, as handles 22 and 24 are pulled in the direction of arrows 64 and 66, the harness 12 is pulled down, thereby stretching the knee joint of patient 78.

In the process of this invention, it is preferred to rest the patient's leg upon some surface such as, e.g., stool 80. Thereafter, the patient may place harness 12 over his kneecap and secure each of hook pulley systems 18 and 20 into one or more screw eyes such as, e.g., screw eye 68. Once the leveraging device 10 has been secured, the patient 78 may then reach down and grasp the handles 22 and 24, pull backwards and upwards in the direction of his thigh, thereby pulling harness 12 down. Once harness 12 has been pulled down to the desired extent, the patient 78 may maintain the tension on such harness. One convenient means of so doing is to rest handles 22 and/or 24 against the patient's thigh and hold the handles in place there with one or both hands.

THE FEXION HARNESS

The device 10 described in the first part of this specification is a leverage extension system for straightening a knee joint. The device described below is a leverage flexion system for flexing the knee joint.

The leverage flexion system is comprised of a seat harness and an ankle cuff.

Figure 7:
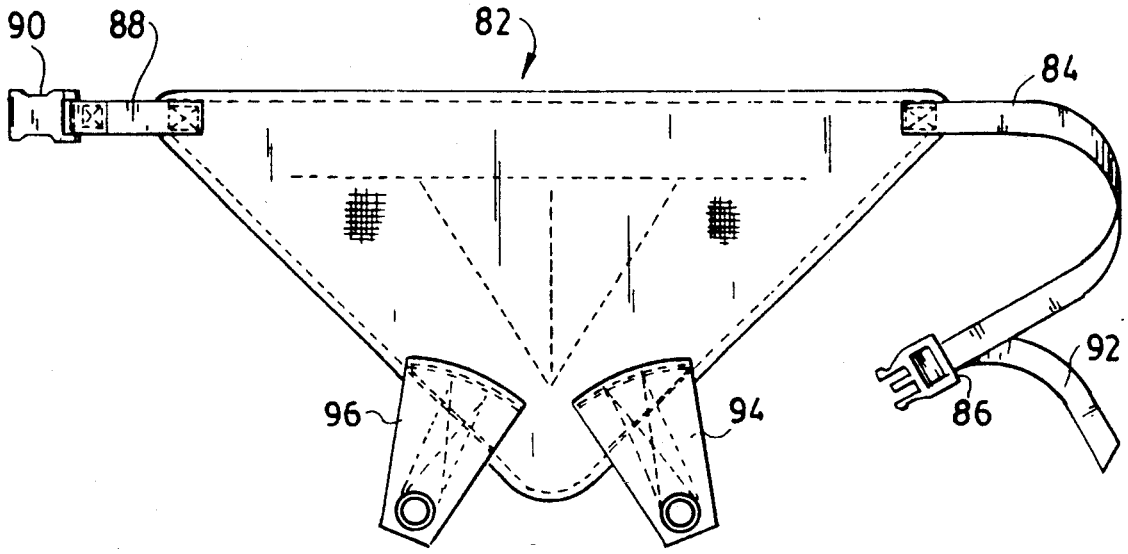
FIG. 7 is a front view of an unbuckled seat harness described in this specification.

Referring to FIG. 7, seat harness 82 is comprised of a means for securing the harness to a patient's hips. These securing means comprise belt 84, fastener 86, belt 88, and fastener receptacle 90.

Any of the fasteners and/or fastener receptacles commonly used for securing nylon webbing may be used as elements 86 and/or 90. Thus, e.g., one may use the devices described in U.S. Pat. Nos. 4,150,464 and/or 4,171,555, the disclosures of which are hereby incorporated by reference into this specification.

In the preferred embodiment of FIG. 7, belt 84 is secured to harness 82 by conventional means such as, e.g., sewing. This belt may comprise or consist of any belting material. One preferred belting material, which may be used for both belt 84 and belt 88, is nylon webbing material.

The belt 84 is preferably attached to a fastener, such as fastener 86. Any of the belt fasteners which are known to those skilled in the art may be used as fastener 86. Thus, by way of illustration and not limitation, one may use a "FASTEX" buckle (which is manufactured by the Illinois Tool Works, and which is distributed by the Liberty Mountain Sport Corporation of Liberty, Calif.).

Belt 88 is also attached to harness 82 by conventional means such as, e.g., by sewing. The end of belt 88 is attached to a fastener receptacle 90 such as, e.g., a "FASTEX" receptacle (available from Tent City of Rochester, N.Y.).

Figure 8:
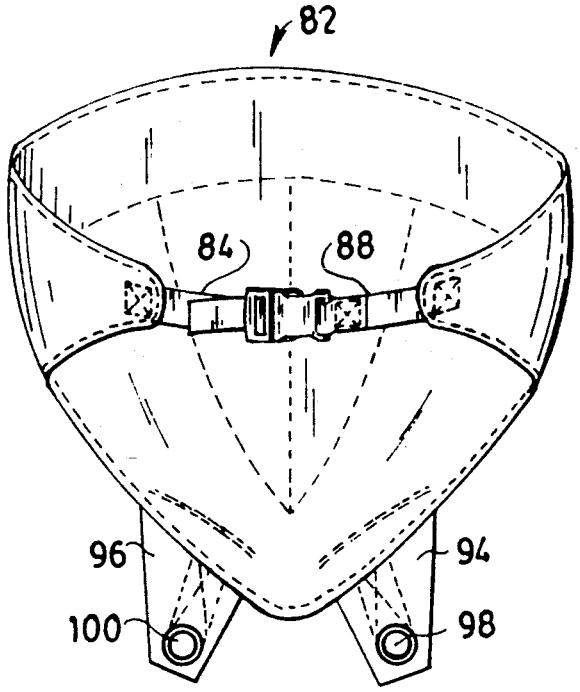
FIG. 8 is a front view of the seat harness of FIG. 7 when said harness is buckled.

As will be apparent to those skilled in the art, When buckle 86 is inserted into receptacle 90, and end 92 of belt 84 is tightened, harness 82 may be drawn around the hips of a patient (not shown); see FIG. 8.

Harness 82 is comprised of two downwardly-extending members, each of which is comprised of an orifice.

Thus, in the preferred embodiment illustrated in FIGS. 7 and 8, harness 82 is comprised of wedge-shaped members 94 and 96. Each of members 94 and 96 is comprised of an orifice which, preferably is a grommet. Thus, e.g., grommets 98 and 100 exist within the lower portions of members 94 and 96, respectively.

Grommets 98 and 100 are each adapted to cooperate with a hook (not shown) in order to removably attach an ankle cuff (see FIG. 11) to one of these grommets. It is preferred that each of grommets 98 and 100 be comprised of a reinforcing ring consisting essentially of nickel-plated bronze.

It will be appreciated by those skilled in the art that harness 82 provides a means of disposing at least one grommet at a point where a patient's hamstring joins his buttock. This grommet then may be connected to an ankle cuff, and thereafter a patient's leg may be fully flexed.

The harness 82 preferably has a sandwich-type structure similar in cross-section to the harness 12. Thus, such harness generally has a total thickness of from about 0.1 to about 0.5 inches and is comprised of at least two polymeric outer layers and at least one inner layer which, preferably, consists essentially of foam material.

Figure 9:
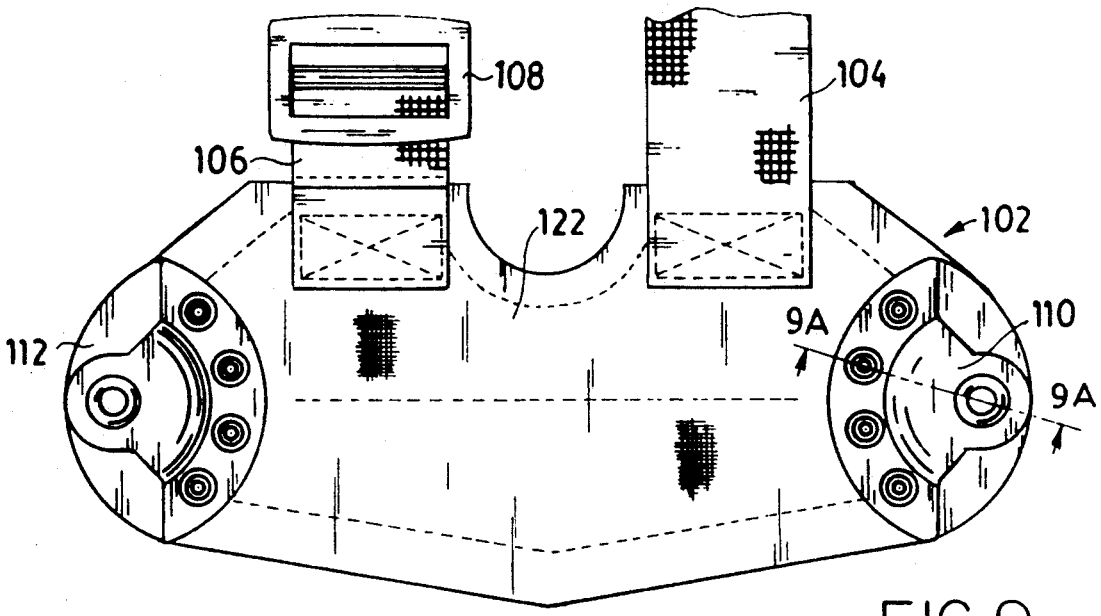
FIG. 9 is a front view of an ankle cuff described in this specification.
Figure 9A:
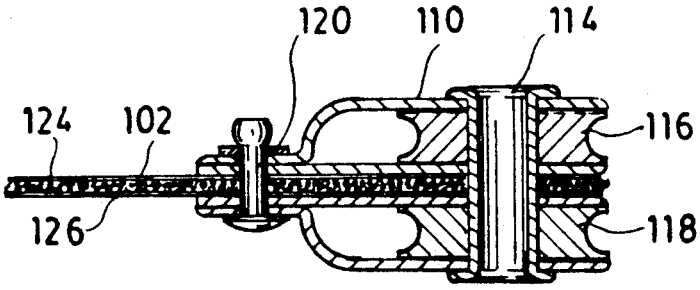
FIG. 9A is a partial sectional view of a pulley block disclosed in the embodiment of FIG. 9.
Figure 10:
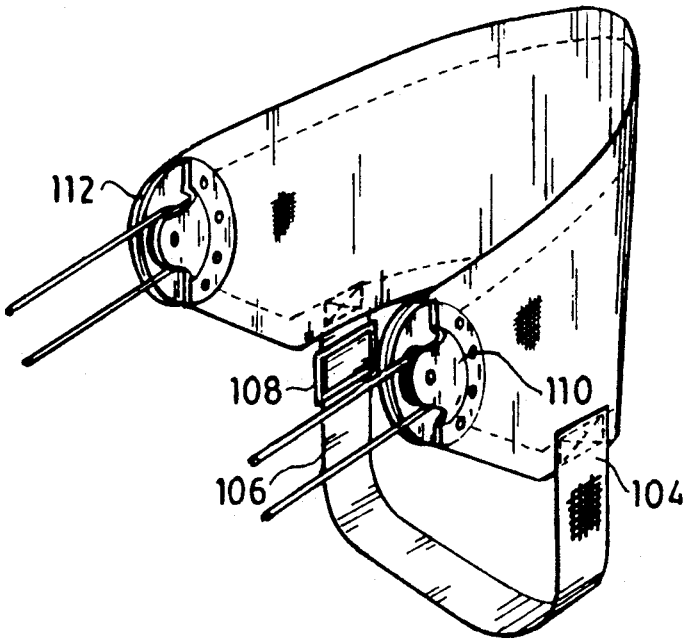
FIG. 10 is a side view of the ankle cuff of FIG. 9.

The ankle cuff used in applicant's flexion system is illustrated in FIGS. 9, 9A, and 10.

Referring to FIG. 9, it will be seen that ankle cuff 102 is comprised of arch strap 104, arch strap 106, slide adjuster 108, pulley block 110, and pulley block 112.

The function of arch straps 104 and 106 is to position the pulley blocks 110 and 112 above the ankle bones of a patient (not shown).

Any of the pulley blocks known to those skilled in the art may be used in applicant's invention. Thus, FIG. 9A is a cross-sectional view of the preferred pulley block illustrated in FIG. 9.

Referring to FIG. 9A, it will be seen that pulley block 110 is comprised of axle rivet 114 and, disposed on said axle rivet, pulley wheels 116 and 118. Aluminum rivet 120 secures pulley block 110 to the ankle cuff 102.

In one preferred embodiment, pulley block 110 is made from two separate members each of which are riveted to the ankle cuff 102 to form the pulley block. Thus, e.g., each of the separate members may be one half of a a two-piece Clew End Pulley Block (available from Bainbridge Aqua Batten Company as part number 128). Each half of this pulley block is attached to an integral ankle-cuff assembly 122.

As will be seen from cross-sectional view 9A, integral ankle cuff assembly member 122 is a flexible sandwich-like structure comprised of at least two outer polymeric layers 124 and 126 (such as the nylon material described elsewhere in this specification) and at least one inner foam layer 128 (such as the "ENSOLITE" foam material described elsewhere in this specification). The belting materials 104 and 106 are preferably sewn to assembly member 122. Assembly member 122 has a thickness of from about 0.125 to about 0.5 inches.

A line is passed through each of pulley blocks 110 and 112 and is connected to a pulley hook which is attached to either of grommets 98 or 100.

Figure 11:
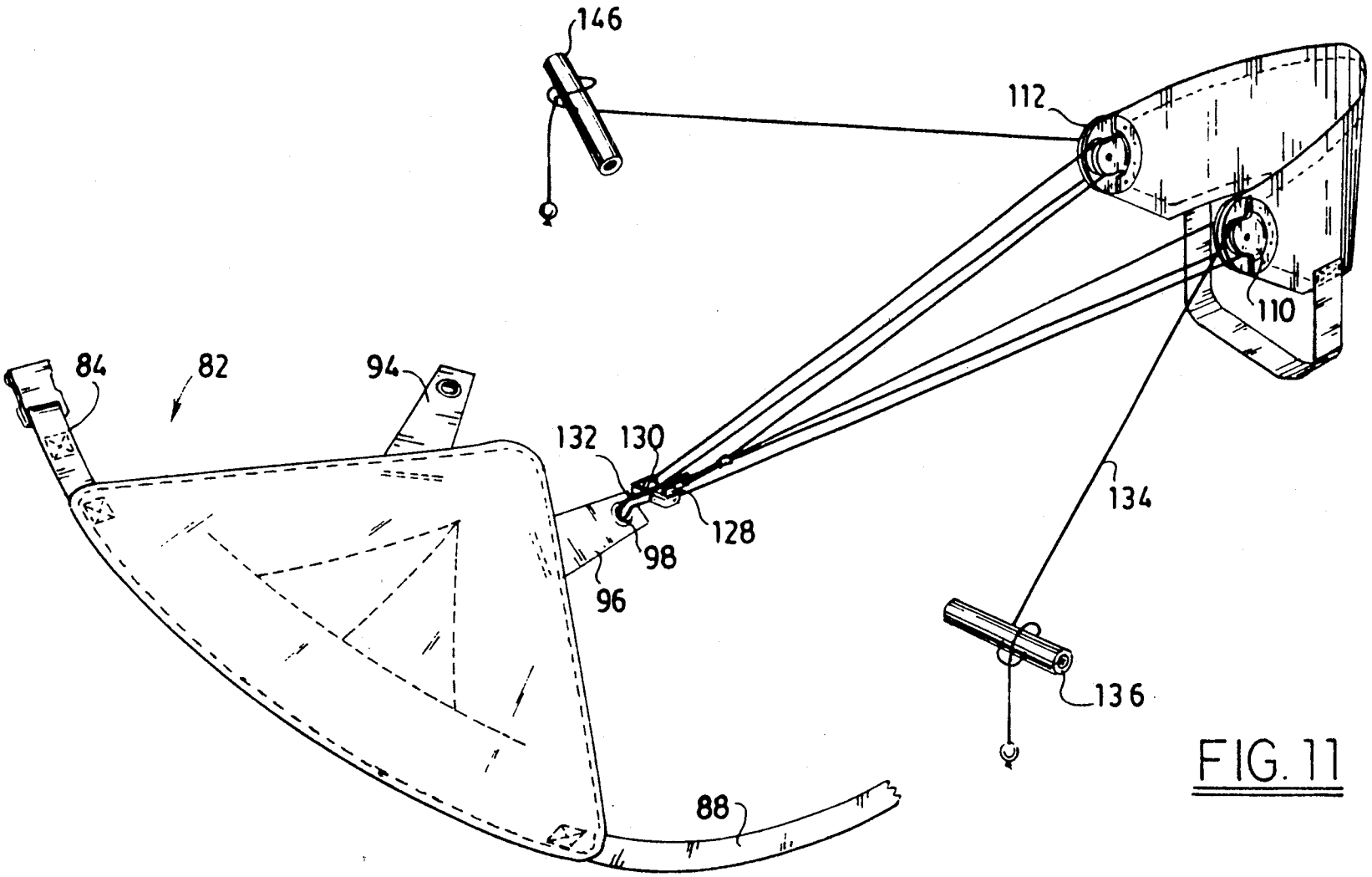
FIG. 11 is an operational view of the ankle cuff/seat harness system of FIGS. 9 and 7.
Figure 12:
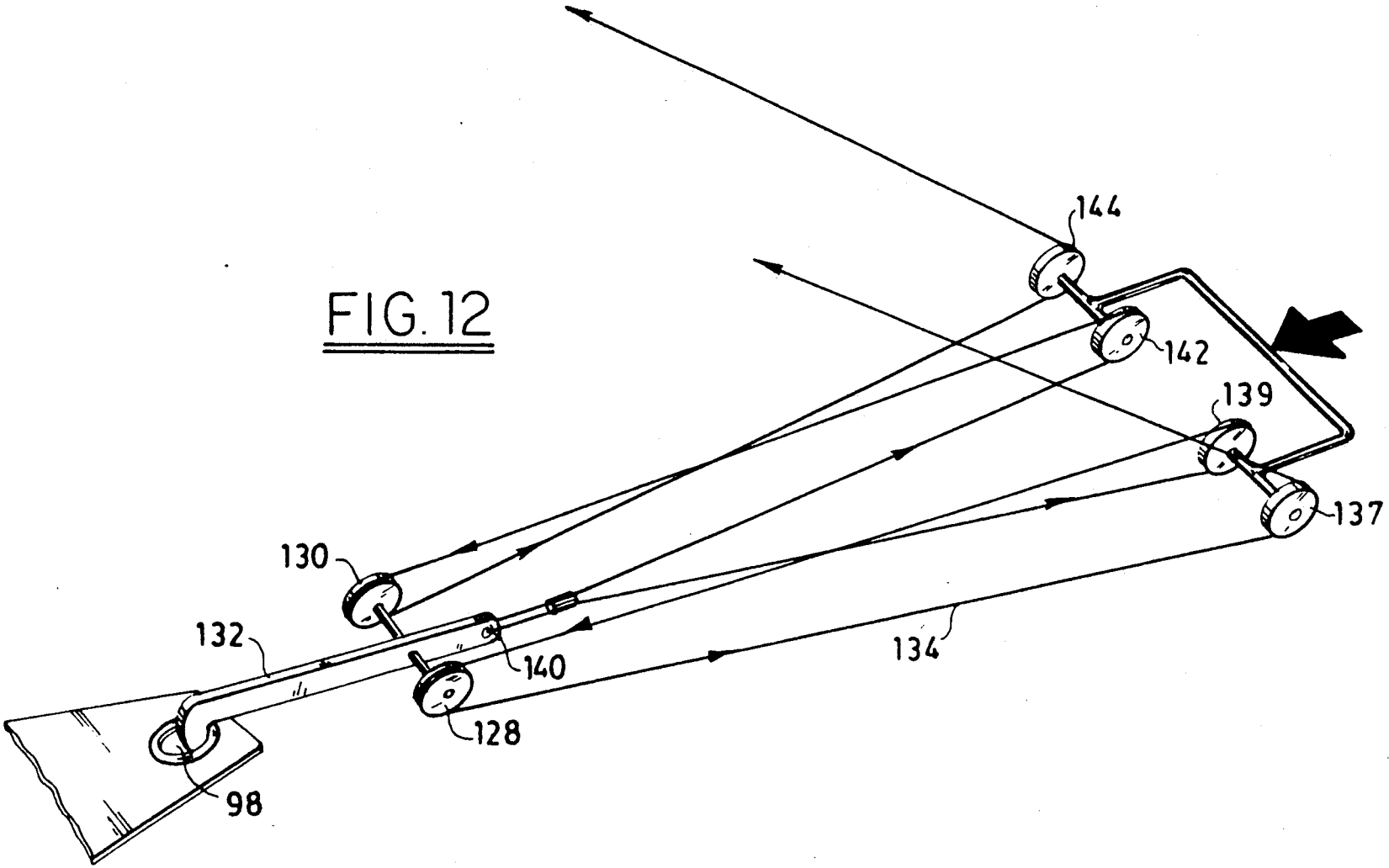
FIG. 12 is a another operational view of the system of FIG. 11, showing how the line used in said system travels.

The operation of this flexion device is illustrated in FIG. 11. As is shown in FIG. 11 and 12, a pulley wheels 128 and 130 are connected via pulley hook 132 to grommet 98. Thereafter, a line 134 is passed through handle 136, and then around the outer pulley wheel 137 of pulley block 110, and then around pulley wheel 128, and then around the inner pulley wheel 139 of pulley block 110, and then through hole 140, and then around inner pulley wheel 142, and then around pulley wheel 130, and then around outer pulley wheel 144, and then connected to handle 146.

Figure 13:
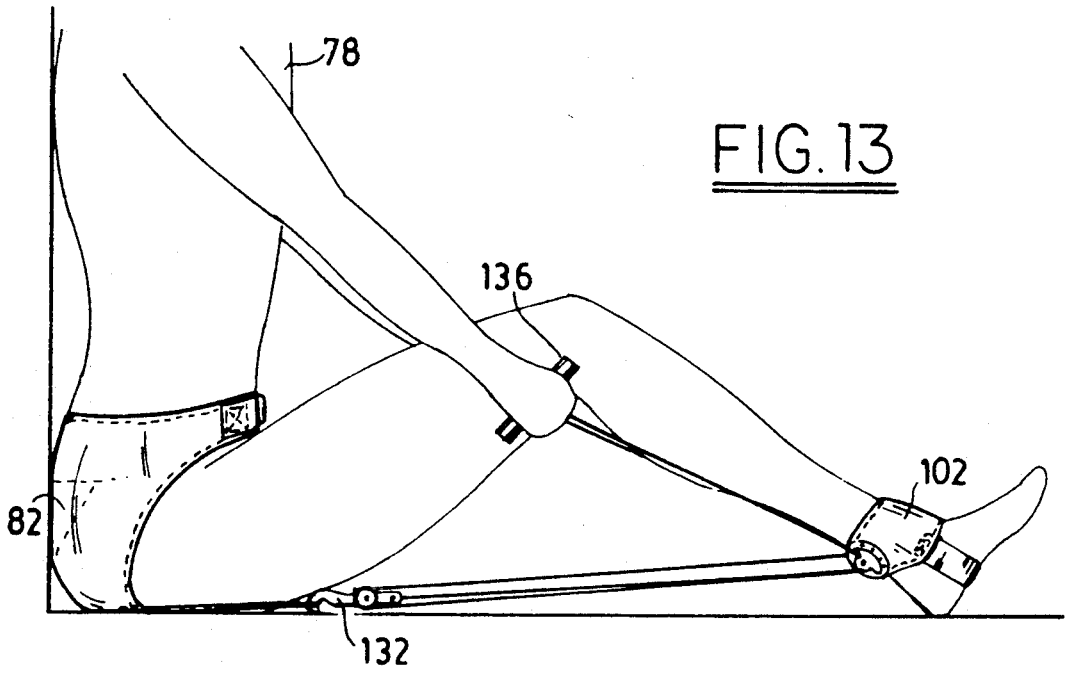
FIGS. 13 and 14 illustrate the system of FIG. 11 being used by a patient.
Figure 14:
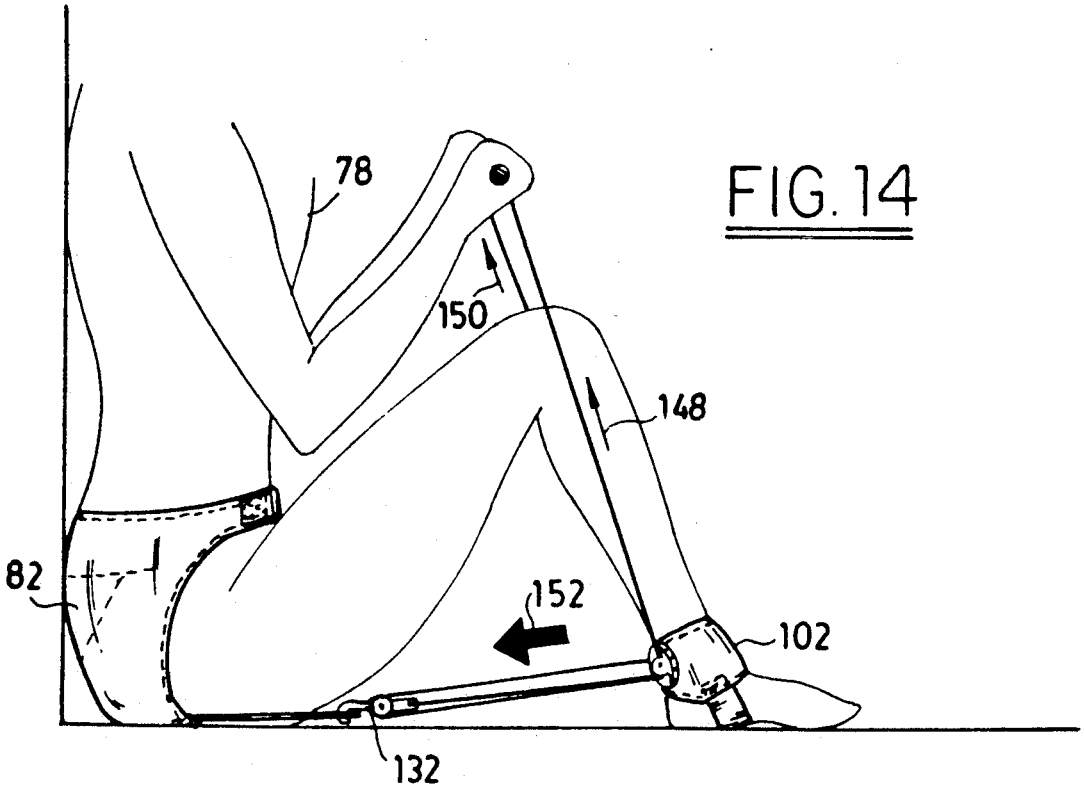

As is illustrated in FIGS. 13 and 14, seat harness 82 may be attached around the waist of the patient 78, and the ankle cuff 102 may be attached on the ankle of the injured leg. The pulley hook 132 is then attached to the grommet corresponding to the injured leg (either grommet 98 or 100), and the handles 136 and 146(not shown) may then be pulled in the direction of arrows 148 and 150, thereby pulling ankle cuff 102 in the direction of arrow 152 towards the patients hips. As will be apparent to those skilled in the art, the more force which is exerted in the direction of arrows 148 and 150, the more the patient's knee is flexed.

It is to be understood that the aforementioned description is illustrative only and that changes can be made in the apparatus, and in the sequence of combinations and process steps as well as in other aspects of the invention discussed herein without departing from the scope of the invention defined in the following claims.

Thus, by way of illustration, instead of the pulley systems 18 and 20, one may pass line cord 14 and/or line cord 16 through screw eyes which may be secured to a fixed surface. Both the pulley systems and and 20 and/or the screw eyes provide means for guiding the line cord.

I claim:

1. An apparatus for stretching a knee joint of the human body, comprising an extension harness comprised of at least a first flap, a second flap, a third flap, a fourth flap, , a first line cord, a second line cord, a means for guiding said first line cord, a means for guiding said second line cord, means for connecting said extension harness to an anchoring surface disposed beneath said extension harness, and means for moving said harness in response to the movement of said first and second line cords, wherein:

(a) said extension harness is a flexible member comprised of at least a first orifice which is substantially centered within said extension harness, wherein:
  1. the maximum dimension of said first orifice is at least about 4 inches,
  2. the maximum width of said harness is at least about 10 inches,
  3. the maximum length of said harness is at least about 15 inches, (b) said first flap is comprised of a first grommet, said second flap is comprised of a second grommet, said third flap is comprised of a third grommet, and said fourth flap is comprised of a fourth grommet;

(c) said line cord has a diameter of from about 0.01 to about 0.5 inches;

(d) said first line cord extends through said means for guiding said first line cord, then through said first grommet, then again through said means for guiding said first line cord, and then through said second grommet, and then to said means of connecting said extension harness to aground anchoring surface; and (e) said second line cord extends through said means for guiding said second line cord, then through said third grommet, then again through said means for guiding said second line cord, and then through said fourth grommet, and then to said means for connecting said extension harness to a ground anchoring surface.

2. The apparatus as recited in claim 1, wherein said extension harness is an integral, flexible member.

3. The apparatus as recited in claim 2, wherein said extension harness is comprised of at least three layers of material.

4. The apparatus as recited in claim 3, wherein said three layers of material are sewn to each other.

5. The apparatus as recited in claim 4, wherein at least two of said three layers of material consist essentially of a synthetic polymeric material.

6. The apparatus as recited in claim 4, wherein at least one of said three layers of material is a coated synthetic polymeric material.

7. The apparatus as recited in claim 5, wherein said synthetic polymeric material is nylon.

8. The apparatus as recited in claim 6, wherein said synthetic polymeric material is nylon.

9. The apparatus as recited in claim 8, wherein at least one of said three layers of material consists essentially of foam.

10. The apparatus as recited in claim 8, wherein at least one of said three layers of material consists essentially of fiberfill.

11. The apparatus as recited in claim 8, wherein at least one of said three layers of material consists essentially of cloth.

12. The apparatus as recited in claim 9, wherein said line cord consists essentially of polyester.

* * * * *